US008567794B2

(12) United States Patent
Davis et al.

(10) Patent No.: US 8,567,794 B2
(45) Date of Patent: Oct. 29, 2013

(54) FRAME STRUCTURE FOR SKATES

(75) Inventors: Stephen J. Davis, Newtown, PA (US); Stefano Conte, Paese (IT); Roberto Gazzara, Venezla (IT); Mauro Pezzato, Treviso (IT); Mauro Pinaffo, Camposampiero (IT); Michel Pozzobon, Treviso (IT)

(73) Assignee: Prince Sports, LLC, New York, NY (US)

( * ) Notice: Subject to any disclaimer, the term of this patent is extended or adjusted under 35 U.S.C. 154(b) by 85 days.

(21) Appl. No.: 12/736,964

(22) PCT Filed: Jul. 1, 2009

(86) PCT No.: PCT/IB2009/052868

§ 371 (c)(1),
(2), (4) Date: Mar. 2, 2011

(87) PCT Pub. No.: WO2010/001351

PCT Pub. Date: Jan. 7, 2010

(65) Prior Publication Data

US 2011/0148054 A1 Jun. 23, 2011

(30) Foreign Application Priority Data

Jul. 3, 2008 (EP) ..... 08159664

(51) Int. Cl.
*A63C 17/18* (2006.01)

(52) U.S. Cl.
USPC ..... 280/7.13; 280/841; 280/11.12; 280/11.18

(58) Field of Classification Search
USPC ..... 280/7.13, 7.14, 11.12, 11.18, 11.19, 280/11.224, 11.225, 11.27, 28, 841
See application file for complete search history.

(56) References Cited

U.S. PATENT DOCUMENTS

| | | | | |
|---|---|---|---|---|
| 1,243,077 | A | 10/1917 | Kuchtik | |
| 1,371,608 | A | 3/1921 | Drevitson | |
| 1,646,843 | A | 10/1927 | Winslow | |
| 4,131,288 | A * | 12/1978 | Wilson | 280/11.17 |
| 4,353,562 | A * | 10/1982 | Tiefenthal | 280/7.13 |
| 5,088,749 | A * | 2/1992 | Olivieri | 280/11.18 |
| 5,484,148 | A * | 1/1996 | Olivieri | 280/11.18 |
| 5,641,169 | A * | 6/1997 | Bekessy | 280/11.18 |
| 5,823,543 | A * | 10/1998 | Burns et al. | 280/11.225 |
| 6,039,328 | A * | 3/2000 | Pawlowski et al. | 280/7.13 |
| 6,209,889 | B1 * | 4/2001 | Alfieri et al. | 280/11.224 |
| 6,523,835 | B1 * | 2/2003 | Lyden | 280/11.12 |
| 6,623,017 | B1 * | 9/2003 | Steinhauser, Jr. | 280/11.18 |
| 6,932,361 | B2 * | 8/2005 | Steinhauser, Jr. | 280/11.18 |
| 7,896,363 | B2 * | 3/2011 | Lovejoy | 280/7.13 |

* cited by examiner

*Primary Examiner* — Hau Phan
(74) *Attorney, Agent, or Firm* — R. Blake Johnston, Esq.; DLA Piper LLP US

(57) ABSTRACT

A skate frame comprises a lower frame portion comprising gliding means for running on a gliding surface and an upper frame portion comprising one or more support surfaces for supporting the user's boot. Both the frame portions comprise protruding arms that are mechanically coupled. The mutual interlock between the coupling surfaces of said protruding arms prevent relative movements between the frame portions along predefined directions.

11 Claims, 18 Drawing Sheets

FRAME STRUCTURE FOR SKATES

FIELD OF THE INVENTION

The present invention relates to an improved frame structure for skates, such as ice skates or in-line roller skates.

DESCRIPTION OF RELATED ART

As it is widely known, each type of skate is characterized by a different frame structure.

In the case of figure ice skates, a steel blade is used as a gliding surface, which is fused together with an upper frame portion that attaches to the sole of the user's boot.

As shown in U.S. Pat. No. 3,537,716, a one-piece structure is thus created, which is very strong and durable. Unfortunately, this assembly is generally quite heavy and rigid. Much of the shocks and vibrations are transmitted to the skater because there is no means to damp the vibrations generated during the skating activity.

In a traditional hockey ice skate, the upper portion of the frame is generally made of a plastic material. Suitable fasteners are used to permanently or movably attach a lower frame portion, which includes a steel blade, to this upper frame portion to provide a skate running surface.

The mentioned plastic upper frame portion is generally adopted to provide means to replace the skate blade. Said plastic frame portion is usually injection molded, which is limited in strength and stiffness because the fibers are short and randomly oriented to provide general isotropic properties.

Therefore, such a frame portion must be large and bulky in the toe and heel connection areas. As a result, the weight of the skate frame is more than necessary.

Furthermore, the thermoplastic materials, which are commonly used in injection molding processes, are susceptible to temperature and humidity and they can change in dimension as well as strength and stiffness.

Finally, in such a traditional skate frame structure, no shock absorption is generally offered when landing on the ice from a jump, or from an impact by a puck or other hard object.

U.S. Pat. No. 4,336,948 shows an example of skate frame where the blade portion has holes into which the plastic upper frame portion is interconnected.

U.S. Pat. No. 5,484,148 describes a further example, in which a blade is held by a rigid member to form an assembly that is secured inside a plastic frame that connects to the boot.

A figure skate frame is shown in U.S. Pat. No. 6,318,738, in which a lighter metal material is U.S. Pat. No. 4,131,288 that describes a light aluminum frame portion, to which a replaceable steel blade portion is attached using fasteners.

Examples, in which a polymer frame portion is attached to a metal blade portion, are described in U.S. Pat. Nos. 3,954,378, 3,967,832, 4,071,938, 4,085,944, 4,093,249, 4,053,168, 4,074,909 and 4,088,435.

U.S. Pat. No. 4,826,183 describes a fiber reinforced boot and frame structure for an ice skate.

U.S. Pat. No. 6,523,835 describes a fiber reinforced skate frame and U.S. Pat. No. 6,105,975 describes a light but rigid skate frame with a truss-like structure that can be made of fiber reinforced composites.

For inline roller type skates, examples of using fiber reinforced composites to reduce weight and improve performance are described in U.S. Pat. Nos. 5,904,360, 5,934,692, 6,328,317, 6,345,827, 6,422,577, 6,446,984, 7,214,337 and 6,851,681 and in the U.S. patent application No. 2004/0195786. There exist numerous examples of creating suspension in skates, primarily in in-line roller type skates, as shown in U.S. Pat. Nos. 6,871,860, 6,543,792, 6,491,309, 6,478,313, 6,209,889, 6,196,557, 6,053,512, 6,029,984, 5,979,916, 5,951,027, 5,918,889, 5,890,724, 5,842,706, 5,823,543, 5,586,774, 5,551,713, 5,551,712 and 5,405,156.

From the considerations above, it is apparent that there exists a continuing need for providing improved frames for skates.

BRIEF SUMMARY

The skate frame, according to the present invention, substantially departs from the conventional concepts and designs of the prior art and it is primarily developed for the purpose of reducing weight, providing tailored stiffness, greater strength, improved vibration damping, improved shock absorption, as well as improved appearance.

The skate frame, according to the present invention, comprises a lower frame portion including gliding means for running on a gliding surface. Said lower frame portion comprises one or more first protruding arms, which are directed substantially upwardly with respect to said gliding means and which comprise one or more first coupling surfaces The skate frame, according to the present invention, comprises also an upper frame portion that includes one or more support surfaces for supporting the user's boot. Said upper frame portion comprises one or more second protruding arms, which are directed substantially channels for accommodating at least partially the first protruding arms of the lower frame portion of the skate frame.

The second protruding arms comprise one or more second coupling surfaces, preferably defined in said connection channels, which mechanically couple with the first coupling surfaces of said first protruding arms.

The mutual interlock between said first coupling surfaces and said second coupling surfaces prevents relative movements between the upper frame portion and the lower frame portion of the skate frame at least along a first reference axis and a second reference axis.

Preferably, the mutually interlocked first protruding arms and connection channels form a stable connection arrangement that prevents relative movements between the frame portions at least along two reference axes that are contained in a horizontal plane, substantially parallel to the gliding surface.

More particularly, relative movements between the frame portions are prevented along a first reference axis, which substantially corresponds to a rearward-forward longitudinal axis of the skate frame, and along a second reference axis, which substantially corresponds to a side-to-side transversal axis of the skate frame.

Relative movements between the frame portions along a third vertical reference axis, which is substantially perpendicular to the gliding surface, may be advantageously prevented by the use of gluing or adhesive materials.

Nonetheless, according to an embodiment of the present invention, the upper and lower frame portions of the skate frame may be arranged so that the mutual interlock between said first and second coupling surfaces prevents by itself relative movements also along said third vertical reference axis, when the user's boot is operatively associated to the skate frame.

In this way, traditional fasteners, such as rivets and screws, may be completely eliminated to join the frame portions, which feature improves weight reduction and aesthetics of the skate frame.

Generally the use of adhesive only without mechanical fasteners presents a risk of the blade de-bonding from the frame during use.

In the present invention this risk is negligible.

In fact, relative movements of the frame portions are per se prevented at least along two reference axes by the mechanical coupling of the mutually interlocking of the mentioned first frame portions, which distributes the loads uniformly across both the frame portions.

In fact, the second protruding arms may preferably form connection channels that have an "U" shaped cross section to further increase said bond area while the first protruding arms may comprise relatively extended tip ends or lateral surfaces.

The lower frame portion of the skate frame is preferably made of a metal material while the upper frame portion is preferably made of composite materials to improve weight reduction, stiffness tailoring, vibration damping, and dimensional control.

The skate frame of the present invention is capable of providing improved vibration damping characteristics and specific stiffness zones at various locations along the skate frame length. In fact, the first and second protruding arms can advantageously be angled according to the needs to vary the amount of passive suspension provided by the skate frame.

The skate frame of the present invention provides a durable and reliable construction, which may be easily and efficiently manufactured at low cost with regard to both materials and labor. Further, a same upper frame portion of the skate frame may be associated to different lower frame portions, each having gliding means of different size.

In this way, a same upper portion may be used for skates having different sizes, which allows to remarkably reduce the production and stocking costs.

Finally, the skate frame, according to the present invention, can be easily arranged to provide a unique look and improved aesthetics.

BRIEF DESCRIPTION OF THE DRAWINGS

For a better understanding of the present invention and its advantages, reference should be made to the accompanying drawings and descriptive matter, in which.

DETAILED DESCRIPTION

Figure 1:
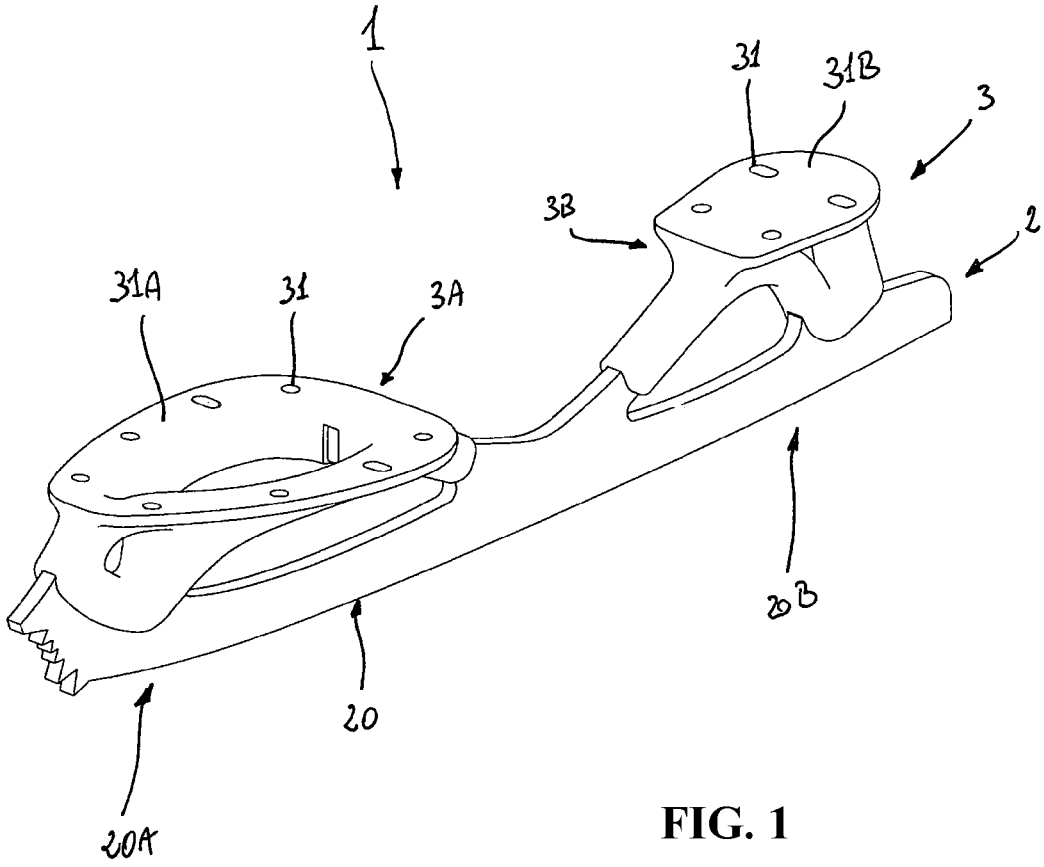
FIG. 1 is an isometric view of the skate frame, according to the present invention, in a first embodiment.
Figure 2:
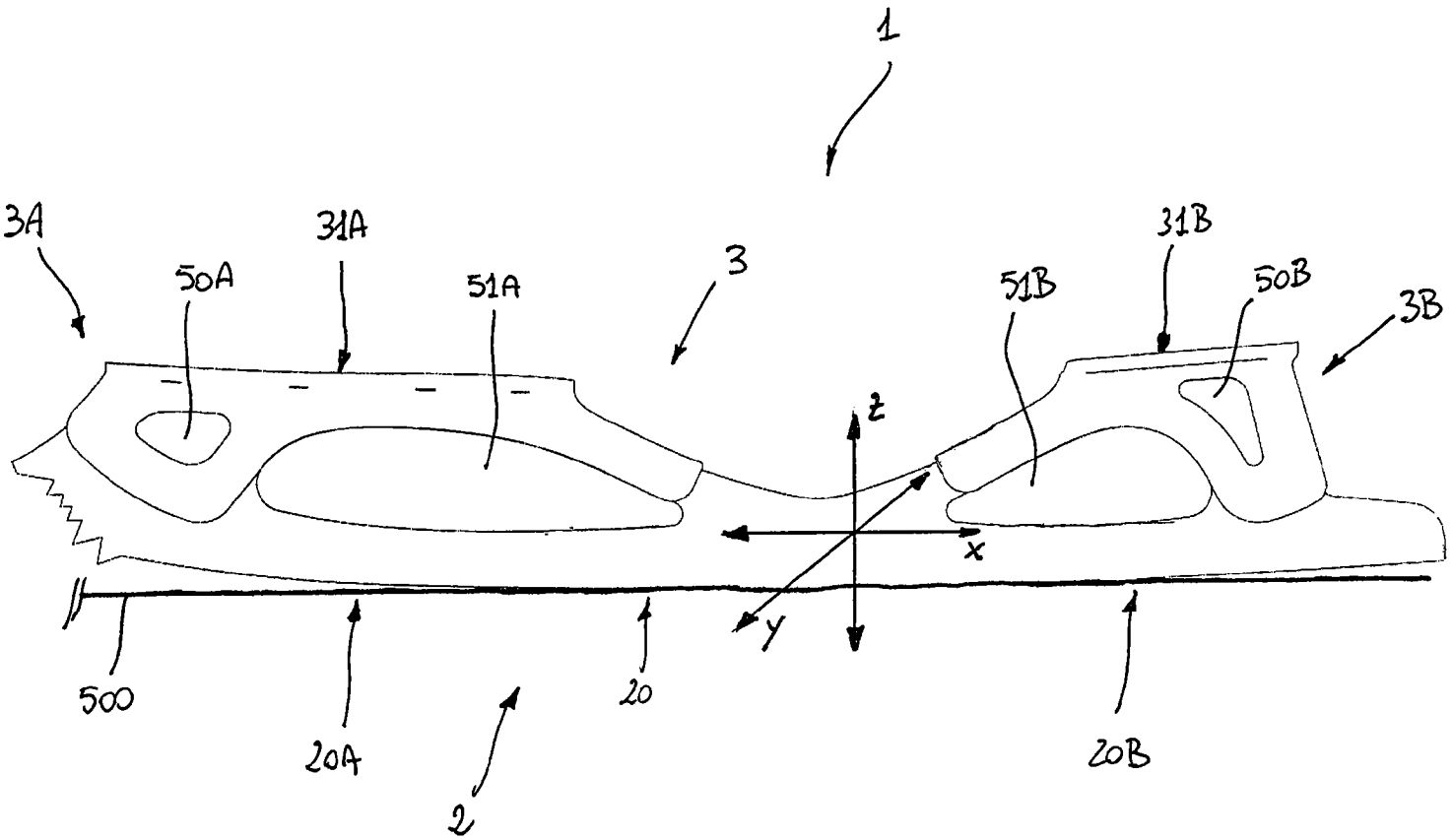
FIG. 2 is a side view of the skate frame of FIG. 1.
Figure 3:
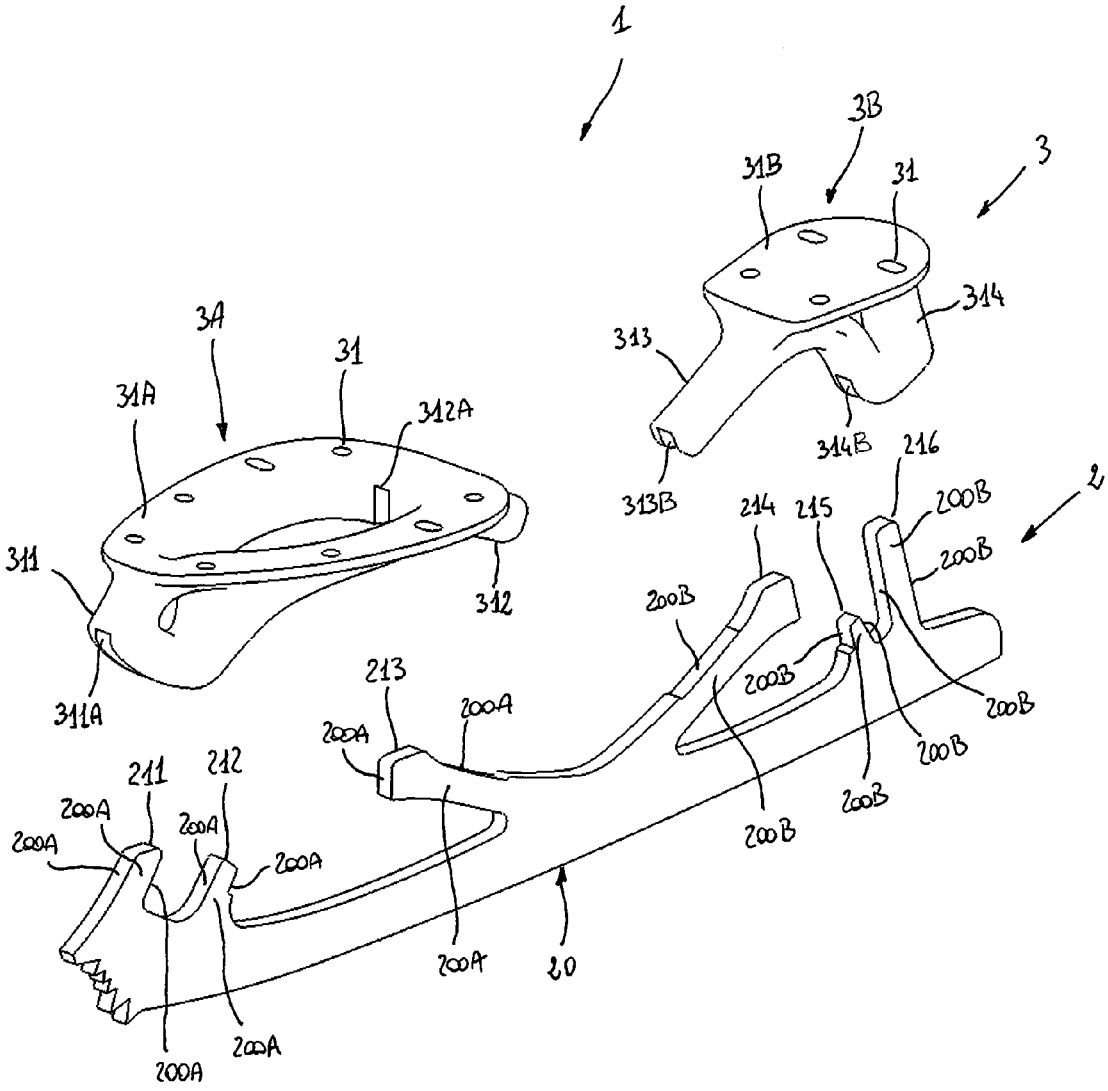
FIG. 3 is an isometric exploded view of the skate frame of FIG. 1.

Referring to the figures above, the present invention relates to a frame structure 1 for skates, which comprises a lower frame portion 2, which includes gliding means 20 for running on a gliding surface 500, and an upper frame portion 3 that includes one or more support surfaces 31A and 31B for supporting the user's boot (not shown).

Figure 17:
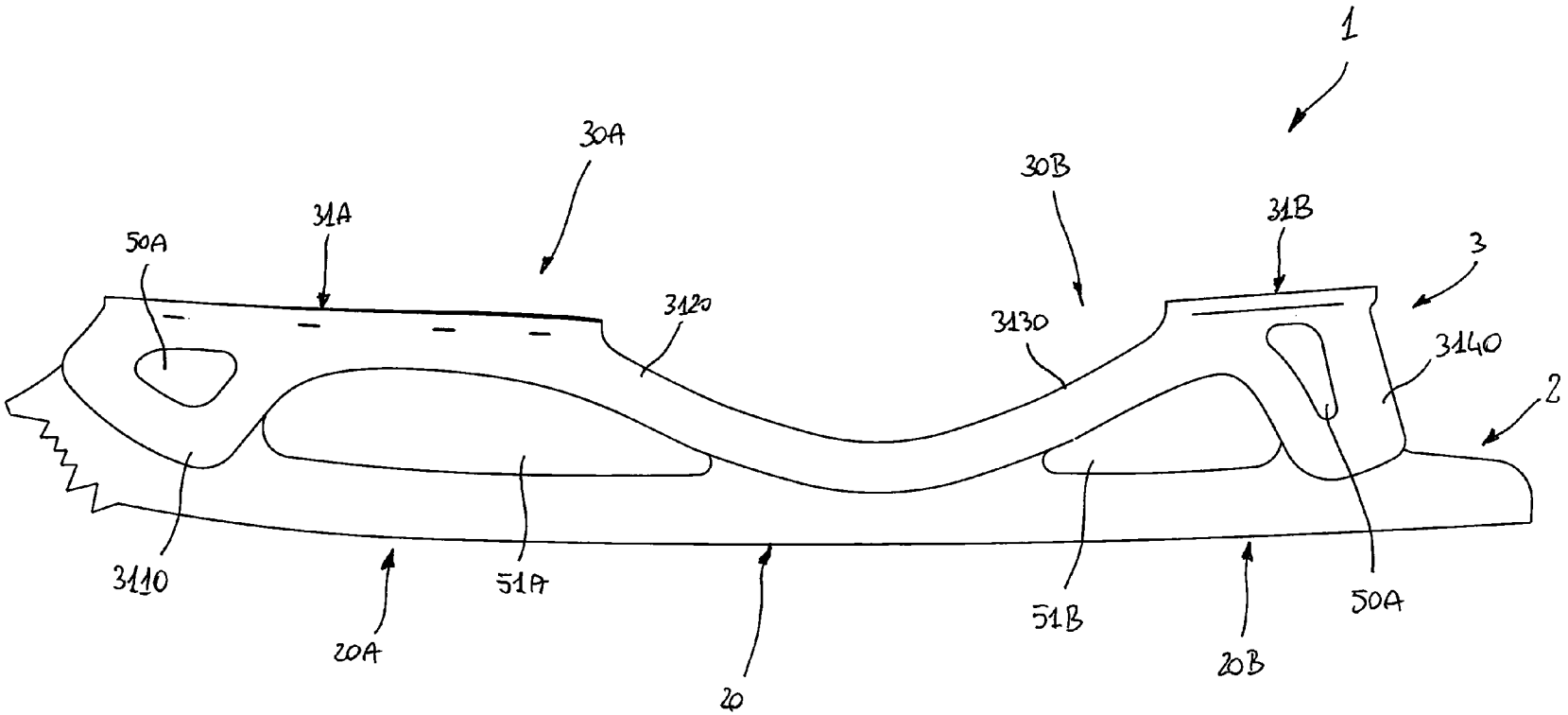
FIG. 17 is a side view of the skate frame, according to the present invention, in a further embodiment.
Figure 18:
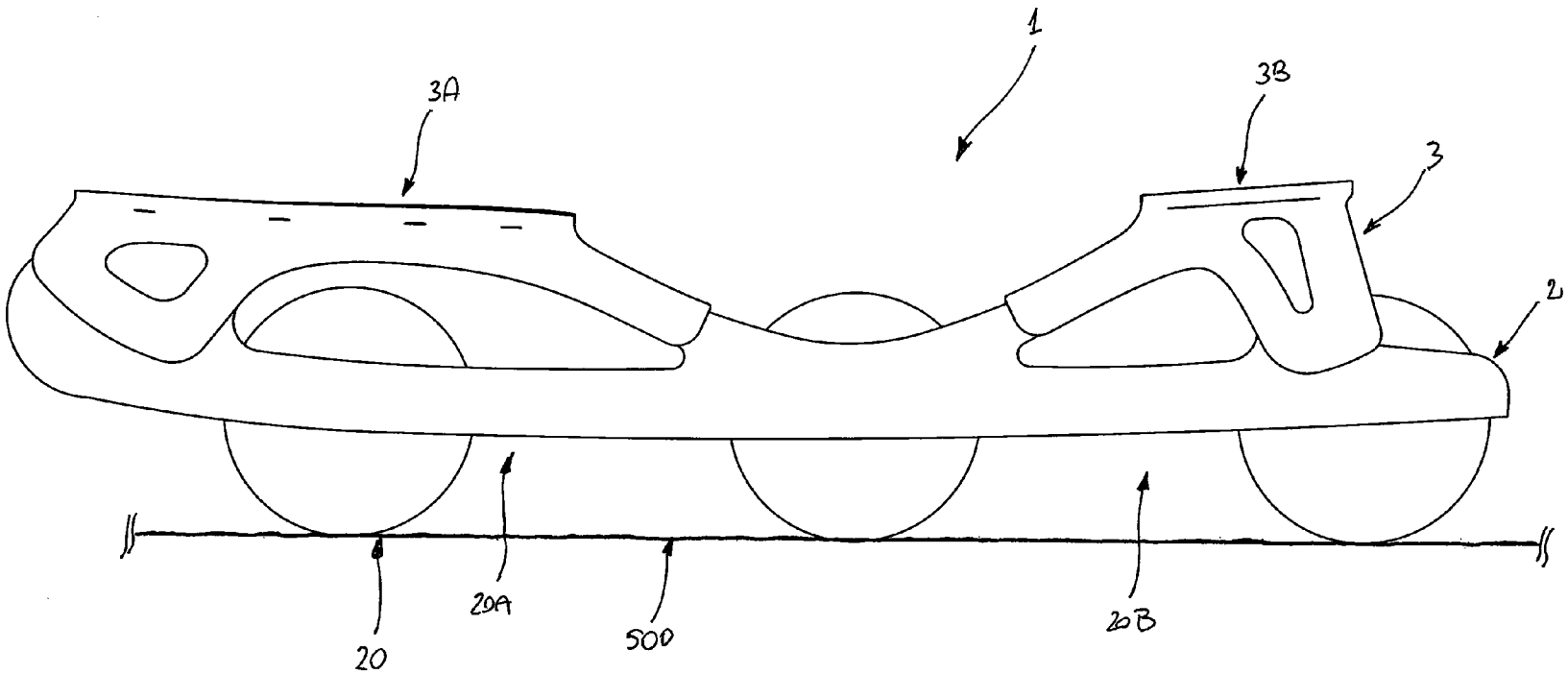
FIG. 18 is a side view of the skate frame, according to the present invention, in a further embodiment.

The gliding means 20 may comprise a steel blade for running on an ice surface, as shown in FIGS. 1-17, or a plurality of in-line wheels for running on the ground, as shown in FIG. 18, or other suitable gliding devices.

The skate frame 1, in fact, may be advantageously used in skates of different types, such as, for example, ice skates (FIGS. 1-17) or in-line roller skates (FIG. 18).

In the following, the skate frame 1 will be mainly described with reference to its application in ice skates for the sake of simplicity only.

The lower frame portion 2 comprises one or more first protruding arms 211, 212, 213, 214, 215 and 216, which are directed substantially upwardly with respect to the gliding means 20, i.e. away from the gliding surface 500.

The first protruding arms comprise one or more first coupling surfaces 200A and 200B, which are advantageously aimed at providing mechanical coupling and offering a suitable area for bonding purposes.

The first protruding arms are preferably cantilevered, where the term "cantilevered arm" refers to extensions of a frame portion that do not re-connect to said frame portion.

Anyway, according to the needs, one or more of the first protruding arms may also have a looped or closed shape.

The support surfaces 31A and 31B of the upper frame portion 3 may be completely flat.

Preferably, the support surfaces 31A and 31B comprise holes 31 for insertion of known attachment means (not shown), such as rivets or screws, for the mechanical connection of the user's boot to the skate frame.

The upper frame portion 3 comprises one or more second protruding arms 311, 312, 313 and 314, which are directed downwardly with respect to the support surfaces 31A and 31B, i.e. towards the gliding surface 500.

Also the second protruding arms may be cantilevered, such as, for example, the protruding aims 312 and 313.

Preferably, said second protruding arms are shaped so as to form one or more connection channels 311A, 312A, 313B and 314B, which comprise one or more second coupling surfaces 300A and 300B that are advantageously aimed at providing mechanical coupling and offering a suitable area for bonding purposes.

The connection channels 311A, 312A, 313B and 314B advantageously accommodate at least partially the first protruding arms 211, 212, 213, 214 215, so that the second coupling surfaces 300A and 300B of said connection channels can mechanically couple with the first coupling surfaces 200A and 200B of said first protruding arms.

Such a mechanical coupling provides a mutual interlock between the first coupling surfaces 200A, 200B and the second coupling surfaces 300A and 300B, respectively, which prevents relative movements between the upper frame portion 3 and the lower frame portion 2 of the skate frame 1 at least along a first reference axis (X) and a second reference axis (Y).

According to a preferred embodiment of the present invention, relative movements between the frame portions 2 and 3 are blocked along axes that lie on a horizontal plane (X, Y) substantially parallel with respect to the gliding surface 500.

More specifically, relative movements of the frame portions 2 and 3 are prevented along a first reference axis X, which substantially corresponds to a rearward forward longitudinal axis of the skate frame, and along a second reference axis Y, which substantially corresponds to a side-to-side transversal axis of the skate frame.

In other words, at least the relative movements of the frame portions 2 and 3 along rearward-forward longitudinal directions and along side-to-side lateral directions are prevented by the described mutual interlocking between the coupling surfaces 200A, 200B and 300A, 300B.

Preferably, adhesive or gluing materials (such as epoxy) are used to bond the frame portions 2 This solution prevents relative movements of the frame portions 2 and 3 along a third vertical reference axis Z substantially perpendicular to the gliding surface 500 and it provides a more secure and stable connection also along the reference axes X and Y.

Preferably, as shown in the cited figures, the mentioned connection channels 311A, 312A, 313B and 314B have a "U"-shaped transversal section while the corresponding first protruding arms 211, 212, 213, 214, 215 and 216 have a rectangular section fitting within the corresponding U-shaped channel.

Advantageously, the first protruding arms may be provided with tip ends of relatively enlarged size (see e.g. the protruding arms 213 and 214) or provided with a stepped profile (see e.g. the protruding arms 212 and 215) in order to form extended bonding areas, which ensure even a safer connection between the frame portions 2-3.

Also, the number of said first protruding arms can be increased to provide a larger bonding area.

Figure 4:
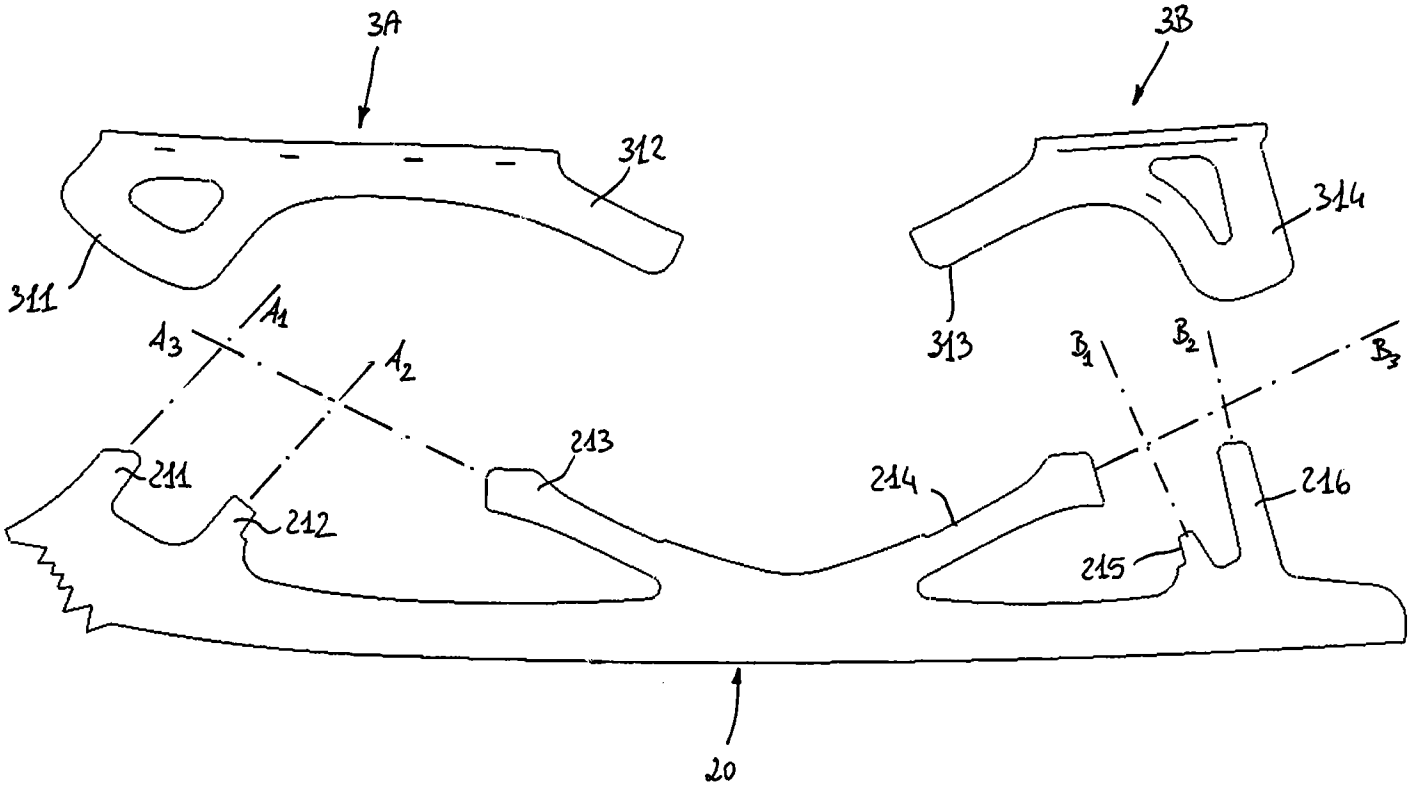
FIG. 4 is a side exploded view of the skate frame of FIG. 1.
Figure 5:
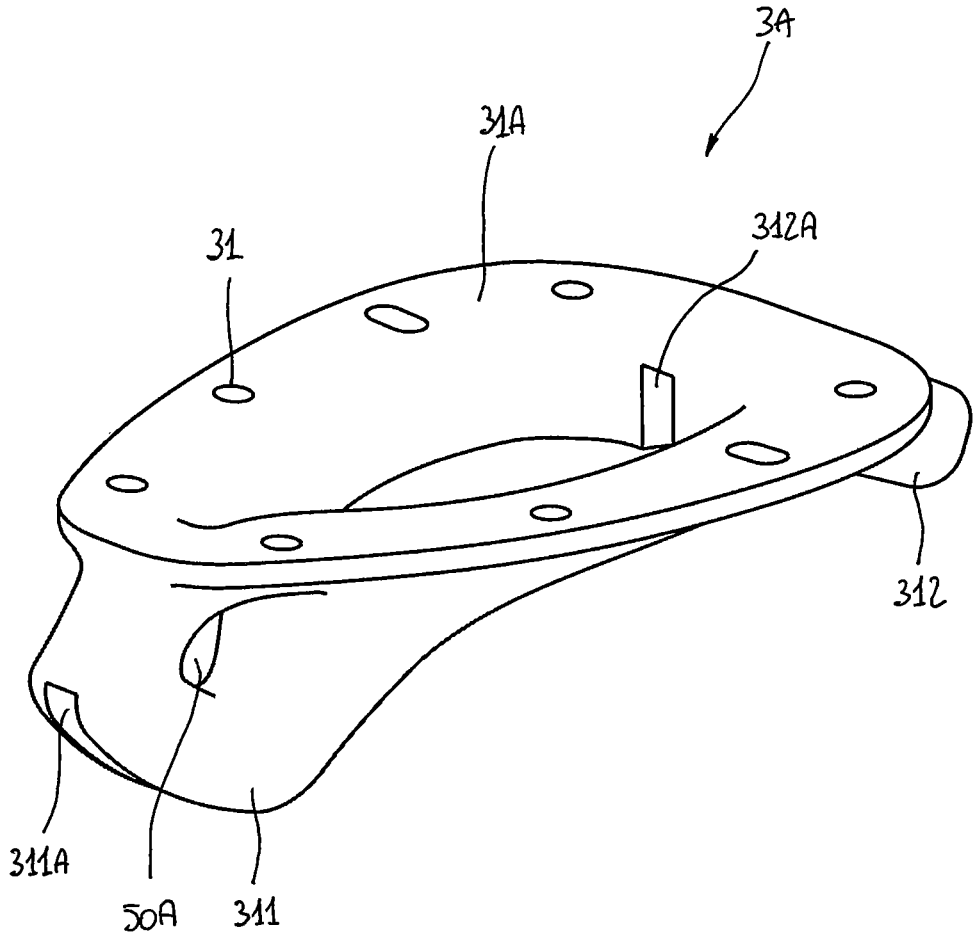
FIG. 5 is an isometric view of a frame member of the skate frame of FIG. 1.
Figure 6:
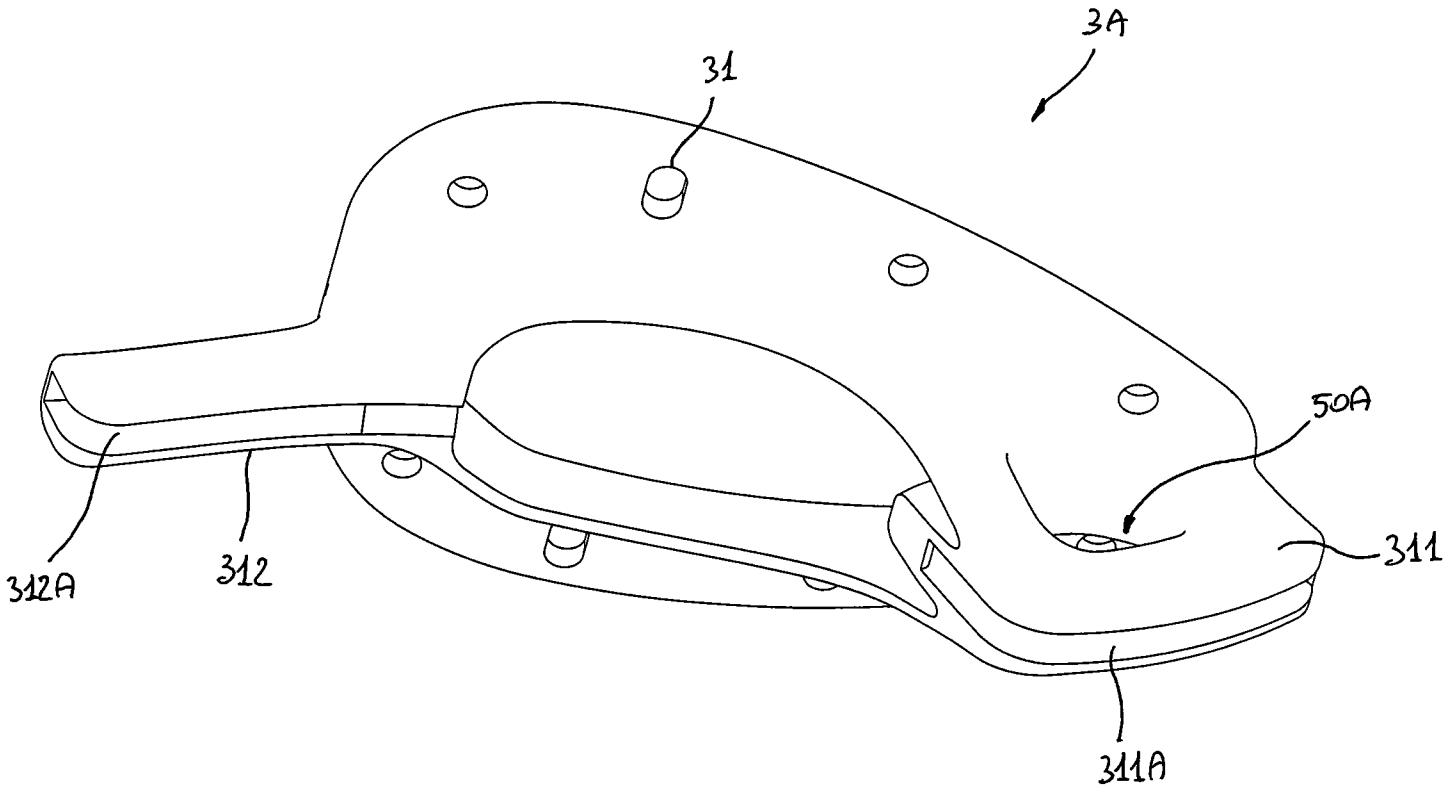
FIG. 6 is a further isometric view of the frame member of FIG. 5.
Figure 7:
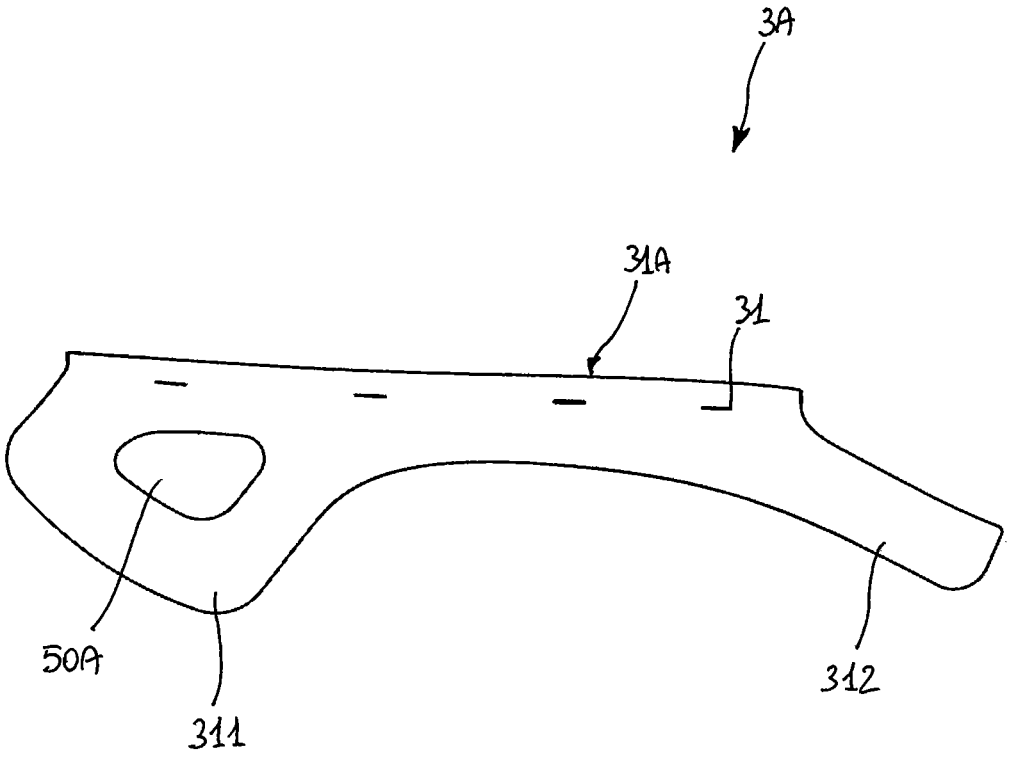
FIG. 7 is a side view of the frame member of FIG. 5.
Figure 8:
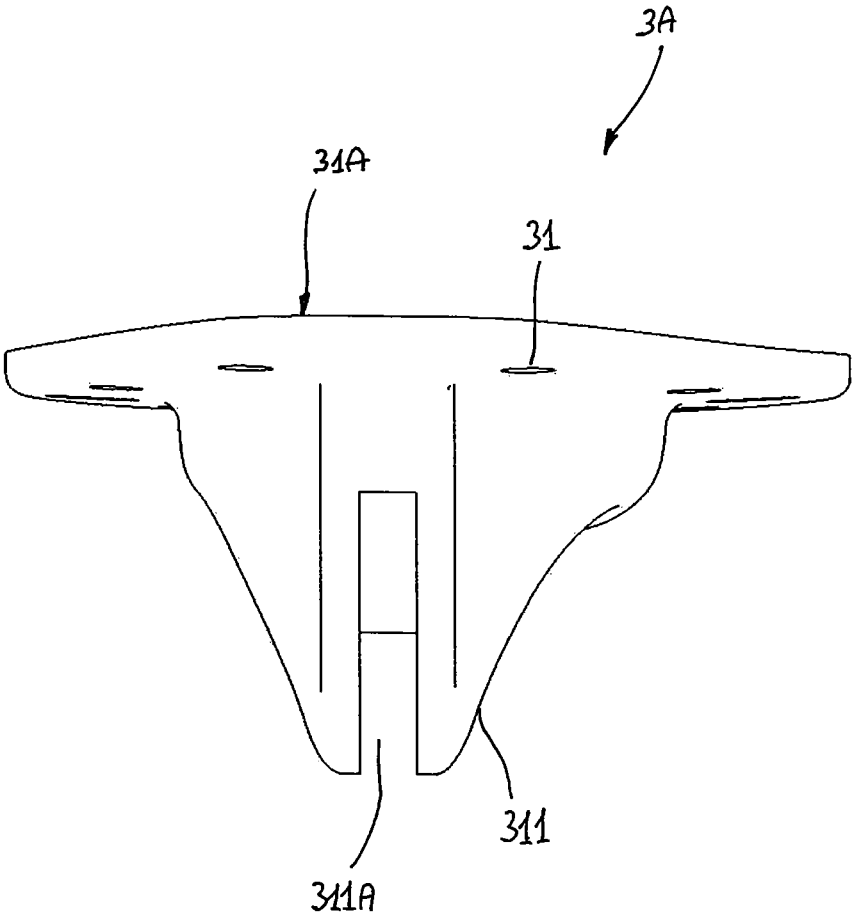
FIG. 8 is a front view of the frame member of FIG. 5.
Figure 9:
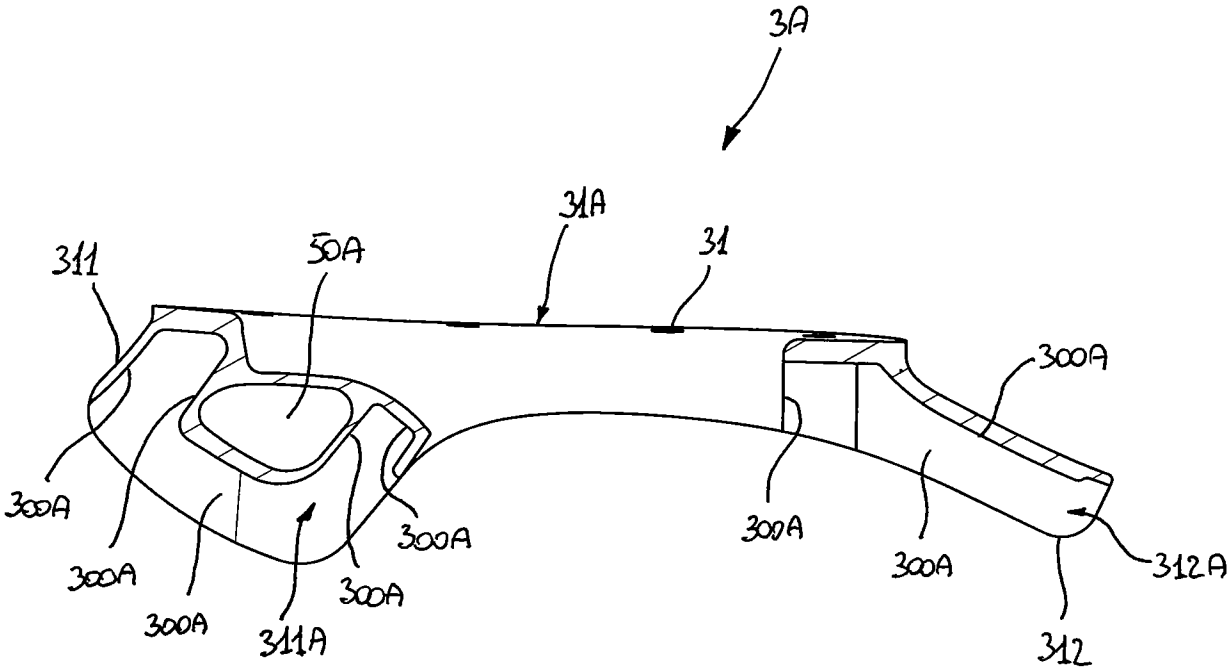
FIG. 9 is a sectional view of the frame member of FIG. 5.
Figure 10:
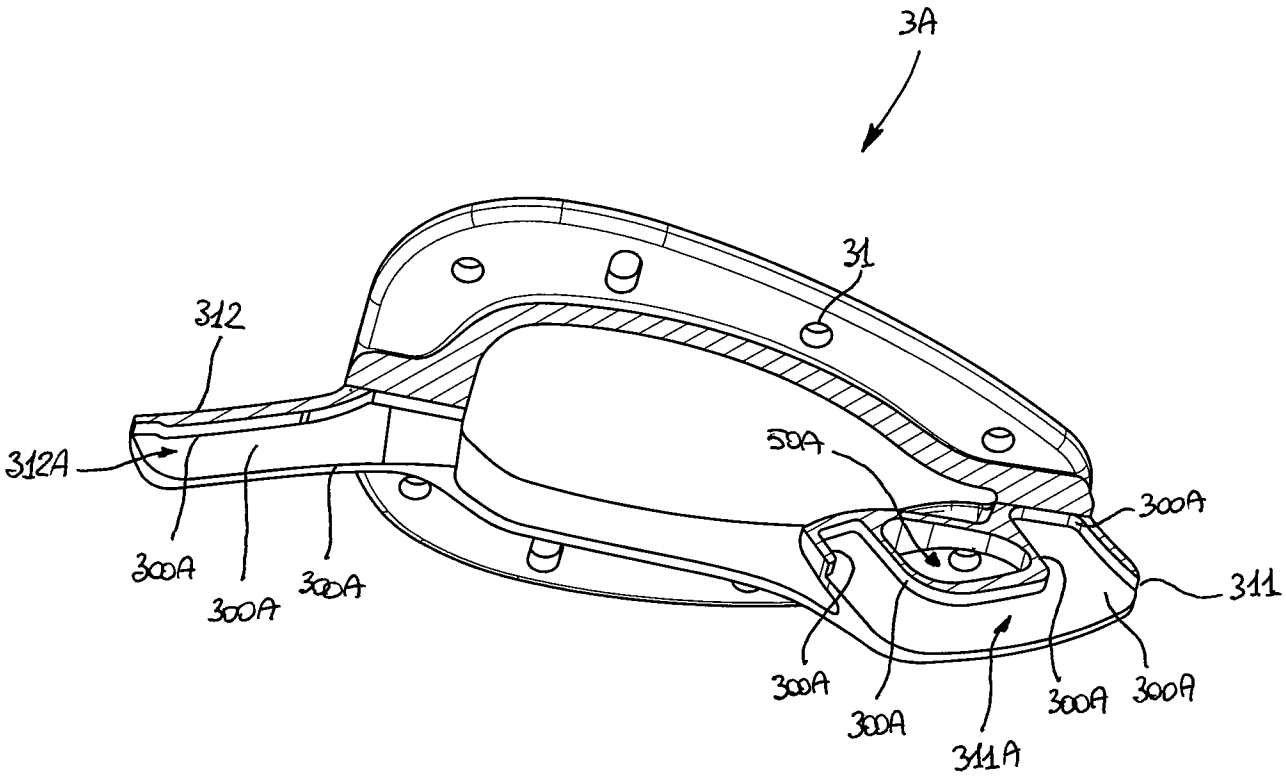
FIG. 10 is a further sectional view of the frame member of FIG. 5.
Figure 11:
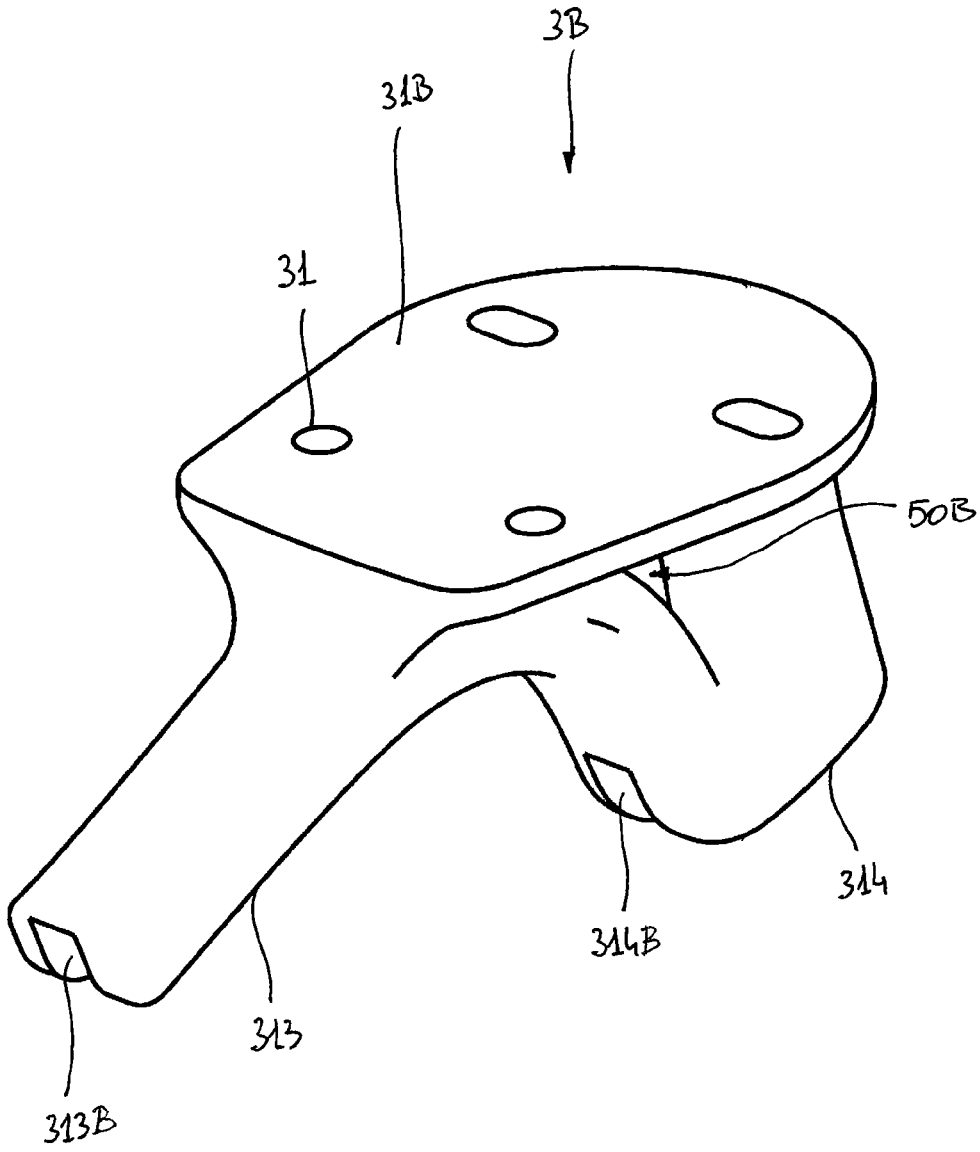
FIG. 11 is an isometric view of a further frame member of the skate frame of FIG. 1.
Figure 12:
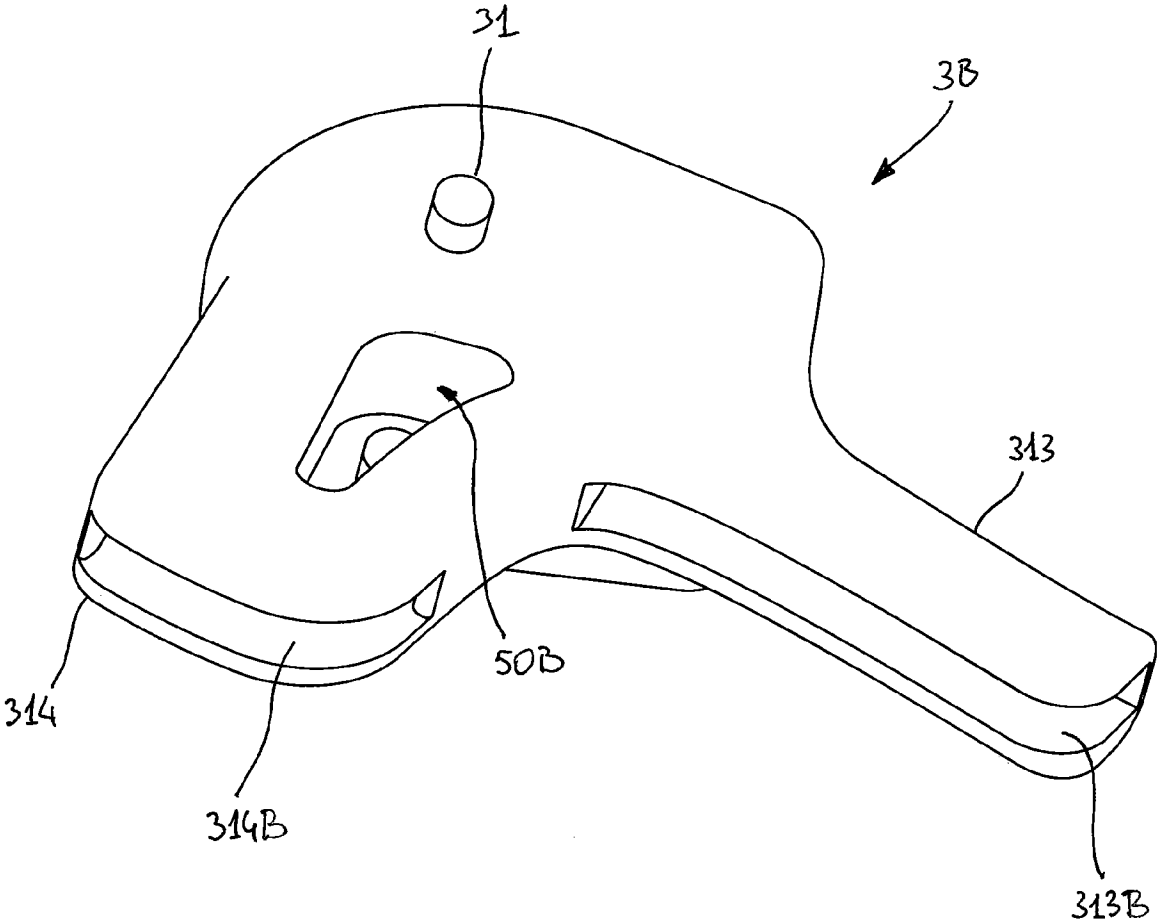
FIG. 12 is a further isometric view of the frame member of FIG. 11.
Figure 13:
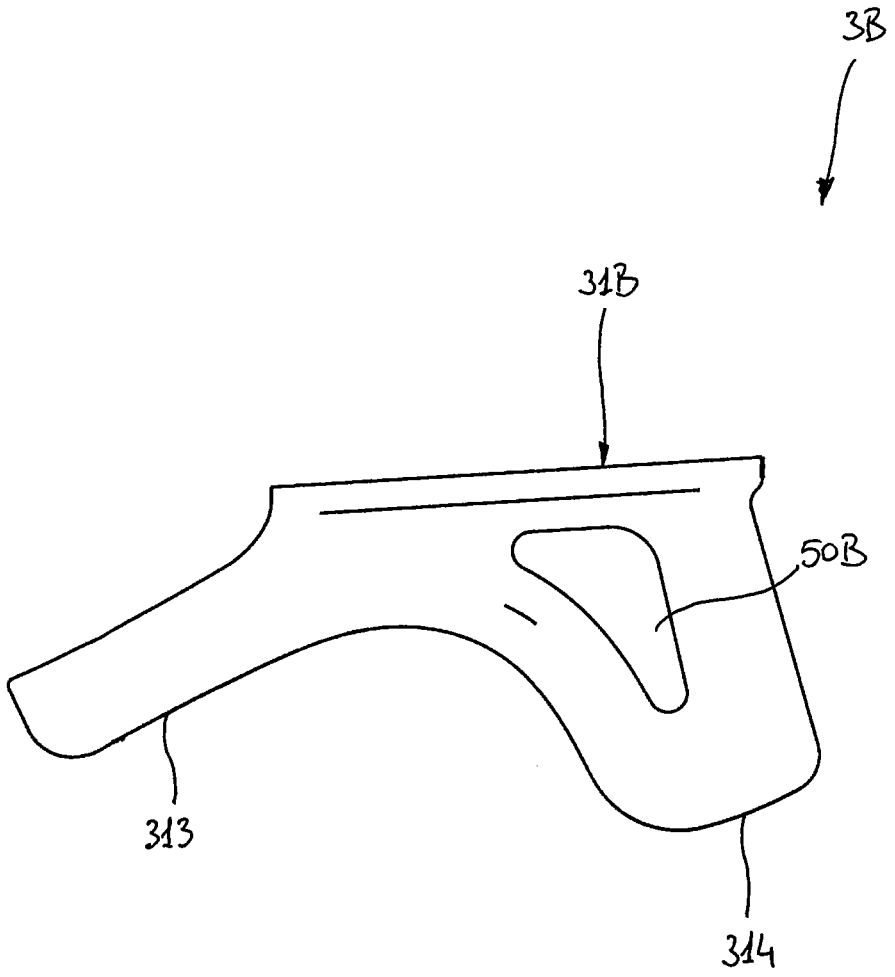
FIG. 13 is a side view of the frame member of FIG. 11.
Figure 14:
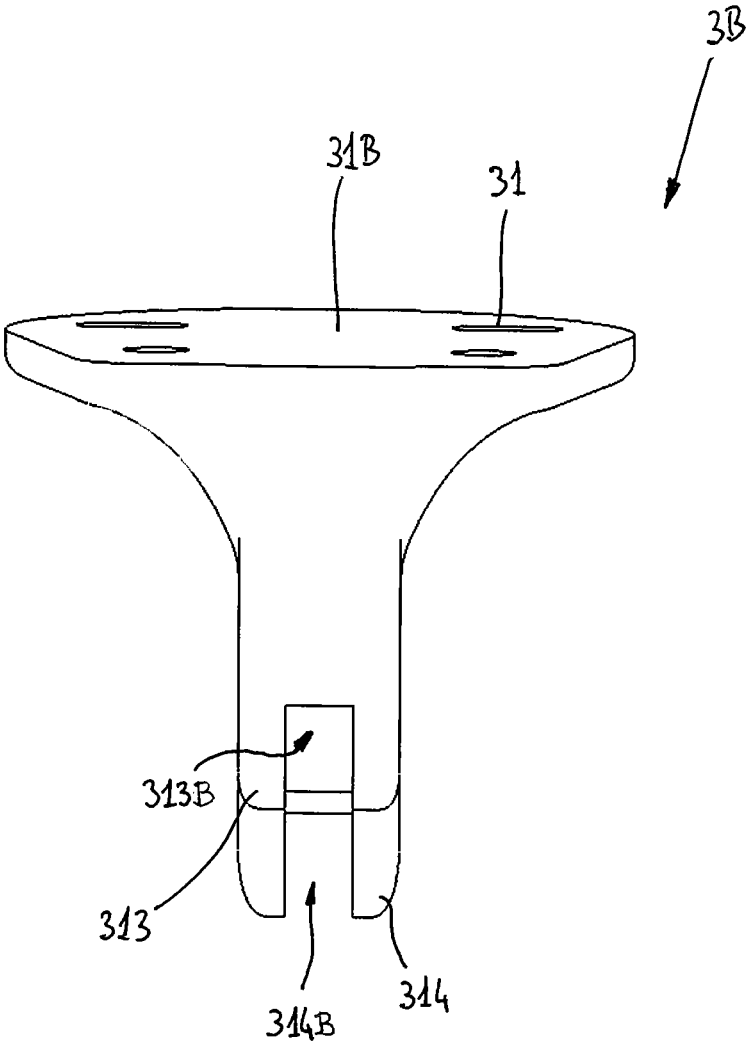
FIG. 14 is a front view of the frame member of FIG. 11.
Figure 15:
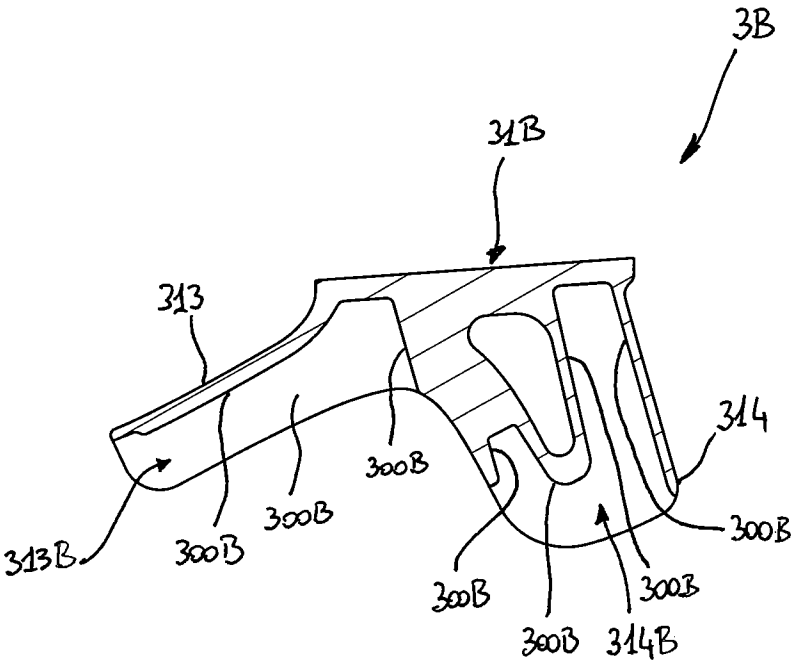
FIG. 15 is a sectional view of the frame member of FIG. 11.
Figure 16:
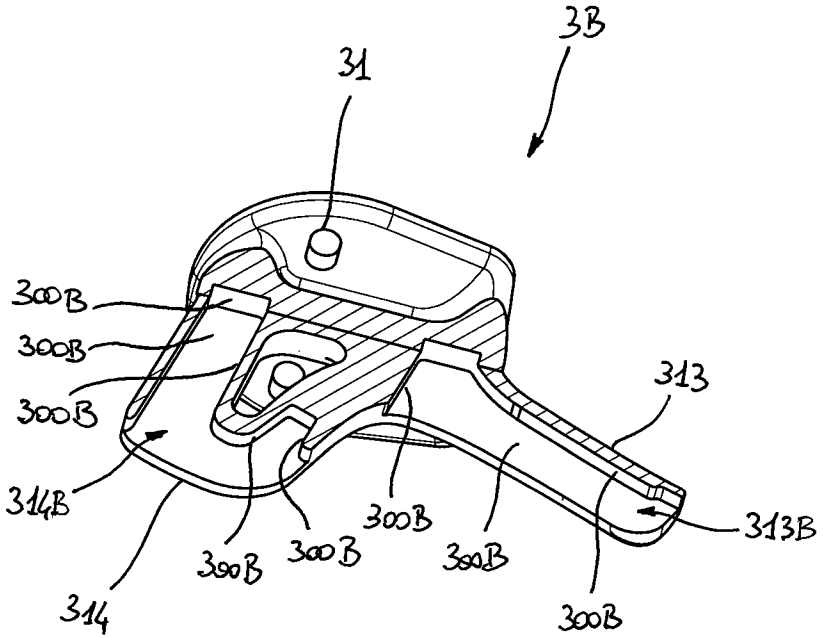
FIG. 16 is a further sectional view of the frame member of FIG. 11.

Since the skate frame substantially extends along the main longitudinal axis X, in the lower frame portion 2 of the skate frame a toe section 20A and a heel section 20B are preferably present (FIG. 4).

The toe section 20A comprises the toe first protruding arms 211, 212 and 213, which comprise the toe first coupling surfaces 200A.

Similarly, the heel section 20B comprises the heel first protruding arms 214, 215 and 216 that comprise the heel first coupling surfaces 200B.

In a preferred embodiment of the present invention, the upper frame portion 3 comprises a toe member 3A and a heel member 3B, which are separated from each other.

Said members 3A and 3B are advantageously operatively associated respectively to the toe section 20A and the heel section 20B of the lower frame portion 2.

To this aim, the toe member 3A comprises the toe second protruding arms 311 and 312, which are directed substantially downwardly with respect to the toe support surface 31A. As described above, these toe second protruding arms 311 and 312 are preferably shaped to define the toe connection channels 311A and 312A, which accommodate the toe first protruding arms 211, 212 and 213 of the toe section 20A of the lower frame portion 2.

In this way, toe second coupling surfaces 300A of said toe connection channels mechanically couple with the toe first coupling surfaces 200A of said toe first protruding arms.

Said heel second protruding arms preferably form the heel connection channels 313B and 314B, which accommodate the heel first protruding arms 214, 215 and 216, so that one or more heel second coupling surfaces 300B of the heel connection channels 313B and 314B mechanically couple with the heel first coupling surfaces 200B of the heel first protruding arms 214, 215 and 216.

The adoption of separate members 3A and 3B for the upper frame portion provides advantages in terms of weight reduction and aesthetics while ensuring an optimal connection of the skate frame 1 with the user's boot.

According to the invention, it is preferable to properly angle the first protruding arms 211, 212, 213, 214, 215 and 216 in order to prevent relative movements between each member 3A-3B of the upper frame portion 3 and the corresponding section 20A-20B of the lower frame portion 2 also along the third vertical reference axis Z, when the user' boot is operatively connected to said members 3A-3B.

For example, at least two of the toe first protruding arms 211, 212 and 213 may be reciprocally angled, so that the mutual interlock between the toe first coupling surfaces 200A and the toe second coupling surfaces 300 can prevent any relative movements of the toe member 3A and the toe section 20A along the third reference axis Z, when the user' boot is operatively connected to the frame members 3A-3B.

To this aim, at least two arms of the toe first protruding arms 211, 212 and 213 can be angled according to opposing orientations, i.e. directed along at least two unparallel axes A1, A2, A3, which preferably lie on a same vertical plane (X, Z) and cross in a region that is positioned upwardly with respect to the gliding surface 500.

For example, in FIG. 4, the axes A1 and A2 are substantially parallel and cross the axis A3 in a region positioned above the sliding means 20. Of course, all the axes A1, A2, A3 may be reciprocally unparallel.

More in general, the toe first protruding arms 211, 212 and 213 may be angled so as to extend along unparallel planes crossing in a region that is positioned upwardly with respect to the gliding surface 500.

In this way, the toe member 3A can be easily operatively associated with the toe section 20A of the lower frame portion 2, during the assembling of the skate frame 1 but any relative movements of the parts along the axes X, Y and Z are prevented once the user's boot has been angled, so that the mutual interlock between said toe first coupling surfaces 200B and the toe second coupling surfaces 300B prevent relative movements also along the third reference axis Z, when the user' boot is operatively connected to the frame members 3A and 3B.

Also in this case, at least two arms of the heel first protruding arms 214, 215 and 216 can be angled according to opposing orientations, i.e. directed along preferably co-planar axes B1, B2, B3 at least two of which are unparallel. The axes B1, B2 and B3 cross in a region that is positioned upwardly with respect to the gliding surface 500.

For example, in FIG. 4, the axes B1, B2 and B3 are all reciprocally unparallel and cross in a region positioned above the sliding means 20.

More in general, the heel first protruding arms 214, 215 and 216 may be angled so as to extend along unparallel planes crossing in a region that is positioned upwardly with respect to the gliding surface 500.

Therefore, also the heel member 3B can be easily operatively associated with the toe section 20B of the lower frame portion 2, during the assembling of the skate frame 1. Again, any relative movements of the parts along the axes X, Y and Z are fully prevented once the user's boot has been fixed to the skate frame 1.

According to an alternative embodiment of the present invention, the upper frame portion 3 is made of a single piece and it presents a toe element 30A and a heel element 30B (FIG. 17). The toe element 30A comprises the toe second protruding arms 3110 and 3120, which are directed downwardly with respect to the toe support surface 31A.

The toe second protruding arms 3110 and 3120 are preferably shaped to define toe connection channels (not shown but preferably similar to those above described), which accommodate toe first protruding arms (not shown but preferably similar to those above described) of the toe section 20A of the lower frame portion 2.

Toe second coupling surfaces of said toe connection channels can thus mechanically couple with corresponding toe first coupling surfaces of said toe first protruding arms.

Similarly, the heel element 30B comprises the heel second protruding arms 3130 and 3140, which are directed downwardly with respect to the heel support surface 31B.

The heel second protruding arms 3130 and 3140 are advantageously shaped to define heel connection channels (not shown but preferably similar to those above described), which accommodate heel first protruding arms (not shown but preferably similar to those above with corresponding heel first coupling surfaces of said heel first protruding arms.

Preferably, the upper and lower frame portions are designed to define a contoured truss-like structure for the skate frame, which comprises one or more openings 50A, 50B, 51A and 51B. A contoured open frame structure that is visible from the side of the skate is thus created. The resulting frame structure has a unitary and sleek appearance, which may be an important factor for certain sports, such as ice figure skating.

The upper frame portion 3 has an increased thickness compared to traditional steel frames, but this is not visible from the side view.

An advantage of the increased thickness is to provide more comfort to the skater when grasping the frame of the skate when performing certain moves during the sports activity. For example, one or more the mentioned openings may be specifically designed with smooth corners to provide improved comfort for fingers placed therein.

The skate frame, according to the present invention, is capable of providing passive suspension effects in order to absorb shocks deriving from jumps and lands of the skaters. Said suspension effects are advantageously offered by the longer first and second protruding arms 213, 214, 312 and 313 of the frame portions 2 and 3, respectively.

The amount of suspension can be easily controlled by the size, length, angle, and contact area between these protruding arms. For example, lower angles between the arms 213-214 and the skate blade 20 will provide more deflection and shock absorption.

Preferably, the lower portion 2 of the skate is at least partially made of metal materials, such as steel or aluminum or titanium in order to provide robustness. They can also be made of ceramic materials and/or nanostructured materials The upper portion 3 is preferably made of composite materials, such as carbon fiber reinforced epoxy materials. This solution offers various advantages.

The use of carbon fiber reinforced composite materials can provide the equivalent stiffness and strength as the traditional steel structure at a much lighter weight.

Further, a strong skate frame structure can be obtained, in which long oriented carbon fibers can provide stiffness and strength in any direction. This anisotropic condition may provide advantages if less or more stiffness is needed in particular areas or directions.

Composite materials damp vibrations better than metals, so the skate frame will provide a quieter, more stable ride compared to traditional steel frames.

Compression molding produces a solid structure with minimal volume. In addition, the "U"-shaped connection channels of the frame portion 2 or frame openings (see the openings 50A, 50B) can be easily formed using this process.

"Prepreg" is a raw material in sheet form with reinforcing fibers impregnated with a thermoset resin such as epoxy. Said resin is in a "B Stage" liquid form, which can be readily cured with the application of heat and pressure. The fibers can be woven like a fabric, or unidirectional, and are of the variety of high performance reinforcement fibers such as carbon, aramid, glass, etc.

The fibers are classified as long fibers, preferably equal or greater than 10 mm in length and specifically oriented to provide the stiffness and strength needed.

The prepreg material commonly comes in a continuous roll or can be drum wound, which produces shorter sheet length segments.

The prepreg is cut at various angles or die cut to specific shapes to achieve the correct fiber orientation.

These strips are typically positioned in the cavity of a mold with multiple layers, orientations, overlaps, and thickness variations depending on the cavity dimensions and strength requirements. The mold is then closed and placed in a heated platen press, which closes the mold to compress the prepreg laminations.

As the temperature rises in the mold, the viscosity of the epoxy resin decreases and the prepreg laminations compress and consolidate, pressing against each other until compaction is complete and the epoxy resin is cross linked and cured.

The mold is then opened and the part is removed from the mold.

A further preferred method to manufacture the upper frame portion in composite materials may comprise injection molding techniques.

Injection molding preferably uses short fibers, typically less than 10 mm in length, and orientation is limited. However, injection molding may be an excellent alternative for a lower cost frame portions or when the upper frame portion does not need to be particularly strong, for example, in children's skate frames. Injection molding could also increase the manufacturing flexibility of the skate frame, which may be desired in certain designs.

Another alternative is to combine injection molding with compression molding to create frame portions with unique properties.

Yet another alternative is to use compression molding using long fibers for the toe frame member and injection molding using short fibers for the heel frame member, or vice versa.

The design of the skate frame structure 1 may be properly arranged to determine the stiffness and resiliency of the skate frame, according to the needs.

Design options include the size, number and orientation of the protruding arms of the frame portions 2 and 3 and the number of equivalent connection points between the upper portion 3 and the gliding means 20. These options determine the mechanical behavior of the skate frame 1 during the skating activity and influence the appearance of the skate frame structure, according to the needs.

What is claimed is:

1. A skate frame comprising:

a lower frame portion comprising gliding means for running on a gliding surface, said lower frame portion comprising one or more first protruding arms, which are directed upwardly with respect to said gliding means, said first protruding arms comprising one or more first coupling surfaces; and an upper frame portion comprising one or more support surfaces for supporting the user's boot, said upper frame portion comprising one or more second protruding arms, which are directed downwardly with respect to said support surfaces, said second protruding arms comprising one or more connection channels that accommodate at least partially said first protruding arms and mechanically couple with said first coupling surfaces, a mutual interlock between said first coupling surfaces and said second coupling surfaces preventing relative movements between the upper frame portion and the lower frame portion of said skate frame at least along a first reference axis (X) that is substantially parallel to said gliding surface and a second reference axis (Y) that is substantially parallel to said gliding surface, wherein said first reference axis (X) substantially corresponds to a rearward-forward longitudinal axis of said skate frame and said second reference axis (Y) substantially corresponds to a side-to-side transversal axis of said skate frame; wherein the upper frame portion of said skate frame comprises a toe member and a heel member, which are separated from each other, said toe member comprising one or more toe second protruding arms, which are directed downwardly with respect to a toe support surface of said toe member, said toe second protruding arms comprising one or more toe second coupling surfaces that mechanically couple with the toe first coupling surfaces of said toe first protruding arms, said heel member comprising one or more heel second protruding arms, which are directed downwardly with respect to a heel support surface of said heel member, said heel second protruding arms being shaped so as to define one or more heel connection channels, said heel connection channels comprising one or more heel second coupling surfaces that mechanically couple with the heel first coupling surfaces of said heel first protruding arms; and wherein a plurality of said heel first protruding arms are reciprocally angled, so that the mutual interlock between said heel first coupling surfaces and said heel second coupling surfaces prevent relative movements between the heel member of said upper frame portion and the heel section of said lower frame portion also along a third reference axis (Z) that is substantially perpendicular to said gliding surface, when the user' a user's boot is operatively connected to said toe member and said heel member.

2. A skate frame according to claim 1, wherein said connection channels are provided with a substantially "U"-shaped cross-section.

3. A skate frame according to claim 1, wherein a plurality of said toe first protruding arms are reciprocally angled, so that the mutual interlock between said toe first coupling surfaces and said toe second coupling surfaces prevent relative movements between the toe member of said upper frame portion and the toe section of said lower frame portion also along a third reference axis (Z) substantially perpendicular to said gliding surface, when the user" boot is operatively connected to said toe member and said heel member.

4. A skate frame according to claim 3, wherein said plurality of toe first protruding arms are directed along unparallel axes, which cross in a region upwardly positioned with respect to said gliding surface.

5. A skate frame according to claim 1, wherein the plurality of said heel first protruding arms are directed along unparallel axes, which cross in a region upwardly positioned with respect to said gliding surface.

6. A skate frame according to claim 1, wherein the upper frame portion of said skate frame is made of a single piece, said upper frame portion comprising a toe element and a heel element, said toe element comprising one or more toe second protruding arms, which are directed downwardly with respect to a toe support surface of said toe element, said toe second protruding arms comprising one or more toe second coupling surfaces that mechanically couple with the toe first coupling surfaces of said toe first protruding arms, said heel element comprising one or more heel second protruding arms, which are directed downwardly with respect to a heel support surface of said heel element, said heel second protruding arms comprising one or more heel second coupling surfaces that mechanically couple with the heel first coupling surfaces of said heel first protruding arms.

7. A skate frame according to claim 6, wherein the first coupling surfaces of said first protruding arms are bonded to the second coupling surfaces of said second protruding arms by at least one of gluing materials or adhesive materials.

8. A skate frame according to claim 7, wherein said upper frame portion and said lower frame portion define a contoured truss-like frame structure, which comprises one or more openings.

9. A skate frame according to claim 1, wherein said upper frame portion comprises composite materials.

10. A skate frame according to claim 9, wherein said upper frame portion comprises a least one of injection molded composite materials or compression molded composite materials.

11. A skate frame according to claim 1, wherein said lower frame portion comprises at least one of metal materials, ceramic materials, or nanostructured materials.

* * * * *

UNITED STATES PATENT AND TRADEMARK OFFICE

CERTIFICATE OF CORRECTION

PATENT NO. : 8,567,794 B2
APPLICATION NO. : 12/736964
DATED : October 29, 2013
INVENTOR(S) : Davis et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 87 days.

Signed and Sealed this
Second Day of June, 2015

Michelle K. Lee

Michelle K. Lee
*Director of the United States Patent and Trademark Office*